US006468139B1

(12) United States Patent
Talieh et al.

(10) Patent No.: US 6,468,139 B1
(45) Date of Patent: Oct. 22, 2002

(54) POLISHING APPARATUS AND METHOD WITH A REFRESHING POLISHING BELT AND LOADABLE HOUSING

(75) Inventors: Homayoun Talieh, San Jose; Konstantin Volodarsky, San Francisco; Jalal Ashjaee, Cupertino; Douglas W. Young, Sunnyvale, all of CA (US)

(73) Assignee: Nutool, Inc., Milpitas, CA (US)

( * ) Notice: Subject to any disclaimer, the term of this patent is extended or adjusted under 35 U.S.C. 154(b) by 0 days.

(21) Appl. No.: 09/684,059

(22) Filed: Oct. 6, 2000

Related U.S. Application Data

(63) Continuation-in-part of application No. 09/576,064, filed on May 22, 2000, which is a continuation of application No. 09/201,928, filed on Dec. 1, 1998, now Pat. No. 6,103,628.

(51) Int. Cl.[7] ..... B24B 21/00

(52) U.S. Cl. ..... 451/296; 451/168; 451/312

(58) Field of Search ..... 451/41, 296, 297, 451/298, 302, 303, 304, 168, 312

(56) References Cited

U.S. PATENT DOCUMENTS

| | | | | | |
|---|---|---|---|---|---|
| 669,923 | A | * | 3/1901 | Grauert | 451/489 |
| 3,888,050 | A | * | 6/1975 | Elm | 451/57 |
| 4,412,400 | A | * | 11/1983 | Hammond | 451/163 |
| 4,802,309 | A | | 2/1989 | Heynacher | 51/62 |
| 5,245,796 | A | | 9/1993 | Miller et al. | 438/692 |
| 5,335,453 | A | | 8/1994 | Baldy | 51/67 |
| 5,377,452 | A | * | 1/1995 | Yamaguchi | 451/1 |
| 5,377,453 | A | * | 1/1995 | Perneczky | 451/1 |
| 5,429,733 | A | | 7/1995 | Ishida | 202/224 |
| 5,489,235 | A | * | 2/1996 | Gagliardi et al. | 451/527 |
| 5,558,568 | A | | 9/1996 | Talieh et al. | 451/303 |
| 5,593,344 | A | * | 1/1997 | Weldon et al. | 451/296 |
| 5,650,039 | A | | 7/1997 | Talieh | 156/636 |
| 5,679,212 | A | | 10/1997 | Kato et al. | 156/345 |
| 5,692,947 | A | * | 12/1997 | Talieh et al. | 451/41 |
| 5,707,409 | A | * | 1/1998 | Martin et al. | 427/380 |
| 5,759,918 | A | | 6/1998 | Hoshizaki et al. | 216/89 |

(List continued on next page.)

FOREIGN PATENT DOCUMENTS

| | | |
|---|---|---|
| DE | 31 13 204 A | 10/1982 |
| EP | 0 517 594 A | 12/1992 |
| WO | WO 97 20660 A | 6/1997 |
| WO | WO 99/22908 | 5/1999 |

*Primary Examiner*—Joseph J. Hail, III
*Assistant Examiner*—David B. Thomas
(74) *Attorney, Agent, or Firm*—Pillsbury Winthrop LLP

(57) ABSTRACT

The present invention is directed to methods and apparatus for polishing a surface of a semiconductor wafer using a pad or belt moveable in both forward and reverse directions. In both VLSI and ULSI applications, polishing the wafer surface to complete flatness is highly desirable. The forward and reverse movement of the polishing pad or belt provides superior planarity and uniformity to the surface of the wafer. The wafer surface is pressed against the polishing pad or belt as the pad or belt moves in both forward and reverse directions while polishing the wafer surface. During polishing, the wafer is supported by a wafer housing having novel wafer loading and unloading methods.

63 Claims, 8 Drawing Sheets

U.S. PATENT DOCUMENTS 5,762,751 A 6/1998 Bleck et al. ..... 156/345
5,770,521 A 6/1998 Pollock ..... 438/692
5,807,165 A 9/1998 Uzoh et al. ..... 451/41
5,810,964 A * 9/1998 Shiraishi ..... 156/345
5,851,136 A 12/1998 Lee ..... 451/9
5,893,755 A 4/1999 Nakayoshi ..... 438/692
5,899,798 A 5/1999 Trojan et al. ..... 451/259
5,899,801 A 5/1999 Tolles et al. ..... 438/692
5,908,530 A 6/1999 Hoshizak et al. ..... 156/345
5,913,716 A * 6/1999 Mucci et al. ..... 451/59
5,951,377 A * 9/1999 Vaughn et al. ..... 451/14
5,961,372 A 10/1999 Shendon ..... 451/41
5,975,988 A * 11/1999 Christianson ..... 451/28
6,017,831 A * 1/2000 Beardsley et al. ..... 442/148
6,068,542 A * 5/2000 Hosokai ..... 451/168
6,110,025 A 8/2000 Williams et al. ..... 451/286
6,113,479 A 9/2000 Sinclair et al. ..... 451/288
6,129,540 A * 10/2000 Hoopman et al. ..... 264/227
6,135,859 A * 10/2000 Tietz ..... 451/303
6,136,715 A 10/2000 Shendon et al. ..... 438/692
6,179,690 B1 * 1/2001 Talieh ..... 451/41
6,179,709 B1 * 1/2001 Redeker et al. ..... 457/6
6,207,572 B1 * 3/2001 Talieh ..... 158/345
6,241,583 B1 * 6/2001 White ..... 451/287
6,302,767 B1 * 10/2001 Tietz ..... 451/303
6,312,319 B1 * 11/2001 Donohue et al. ..... 451/168
6,379,231 B1 4/2002 Birang et al. ..... 451/296
6,413,873 B1 7/2002 Li et al. ..... 438/711

* cited by examiner

POLISHING APPARATUS AND METHOD WITH A REFRESHING POLISHING BELT AND LOADABLE HOUSING

CROSS-REFERENCES TO RELATED APPLICATIONS

This application is a continuation in part of application Ser. No. 09/576,064, filed May 22, 2000, which is a continuation of application Ser. No. 09/201,928, filed Dec. 1, 1998, now U.S. Pat. No. 6,103,628 issued Aug. 15, 2000.

FIELD OF THE INVENTION

The present invention relates to the field of chemical mechanical polishing. More particularly, the present invention relates to methods and apparatus for polishing a semiconductor wafer to a high degree of planarity and uniformity. This is achieved when the semiconductor wafer is polished with pads at high bi-directional linear or reciprocating speeds. The present invention is further directed to a wafer housing for loading and unloading wafers.

BACKGROUND OF THE INVENTION

Chemical mechanical polishing (CMP) of materials for VLSI and ULSI applications has important and broad application in the semiconductor industry. CMP is a semiconductor wafer flattening and polishing process that combines chemical removal of layers such as insulators, metals, and photoresists with mechanical polishing or buffering of a wafer layer surface. CMP is generally used to flatten surfaces during the wafer fabrication process, and is a process that provides global planarization of the wafer surface. For example, during the wafer fabrication process, CMP is often used to flatten/polish the profiles that build up in multilevel metal interconnection schemes. Achieving the desired flatness of the wafer surface must take place without contaminating the desired surface. Also, the CMP process must avoid polishing away portions of the functioning circuit parts.

Conventional systems for the chemical mechanical polishing of semiconductor wafers will now be described. One conventional CMP process requires positioning a wafer on a holder rotating about a first axis and lowered onto a polishing pad rotating in the opposite direction about a second axis. The wafer holder presses the wafer against the polishing pad during the planarization process. A polishing agent or slurry is typically applied to the polishing pad to polish the wafer. In another conventional CMP process, a wafer holder positions and presses a wafer against a belt-shaped polishing pad while the pad is moved continuously in the same linear direction relative to the wafer. The so-called belt-shaped polishing pad is movable in one continuous path during this polishing process. These conventional polishing processes may further include a conditioning station positioned in the path of the polishing pad for conditioning the pad during polishing. Factors that need to be controlled to achieve the desired flatness and planarity include polishing time, pressure between the wafer and pad, speed of rotation, slurry particle size, slurry feed rate, the chemistry of the slurry, and pad material.

Although the CMP processes described above are widely used and accepted in the semiconductor industry, problems remain. For instance, there remains a problem of predicting and controlling the rate and uniformity at which the process will remove materials from the substrate. As a result, CMP is a labor intensive and expensive process because the thickness and uniformity of the layers on the substrate surface must be constantly monitored to prevent overpolishing or inconsistent polishing of the wafer surface.

Accordingly, an inexpensive and more consistent method and apparatus for polishing a semiconductor wafer are needed.

SUMMARY OF THE INVENTION

It is an object of the present invention to provide methods and apparatus that polish a semiconductor wafer with uniform planarity.

It is another object of the present invention to provide methods and apparatus that polish a semiconductor wafer with a pad having high bi-directional linear or reciprocating speeds.

It is yet another object of the present invention to provide methods and apparatus that reduce the size of the polishing station thereby reducing the space and cost of such station.

It is another object of the present invention to provide methods and apparatus that eliminate or reduce the need for pad conditioning.

It is still another object of the present invention to provide a polishing method and system that provides a "fresh" polishing pad to the wafer polishing area, thereby improving polishing efficiency and yield.

It is yet another object of the present invention to provide methods and apparatus for efficiently loading and unloading a semiconductor wafer onto a wafer housing.

These and other objects of the present invention are obtained by providing methods and apparatus that polish a wafer with a pad having high bi-directional linear speeds. In summary, the present invention includes a polishing pad or belt secured to a mechanism that allows the pad or belt to move in a reciprocating manner, i.e. in both forward and reverse directions, at high speeds. The constant forward and reverse movement of the polishing pad or belt as it polishes the wafer provides superior planarity and uniformity across the wafer surface. The wafer housing of the present invention can also be used to securely load, unload, and/or hold the wafer as it is being polished.

BRIEF DESCRIPTION OF THE DRAWINGS

These and other objects and advantages of the present invention will become apparent and more readily appreciated from the following detailed description of the presently preferred exemplary embodiment of the invention taken in conjunction with the accompanying drawings, of which.

DETAILED DESCRIPTION OF THE PREFERRED EMBODIMENTS

Figure 1:
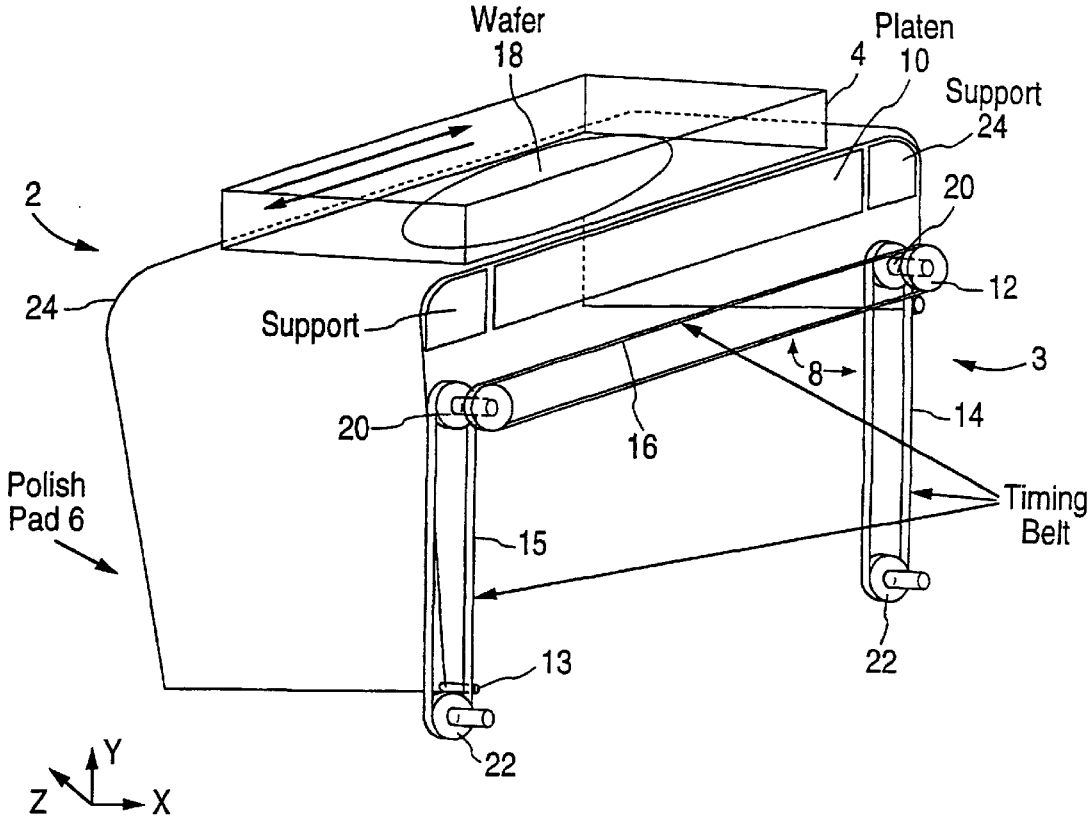
FIG. 1 illustrates a perspective view of a polishing method and apparatus in accordance with the first preferred embodiment of the present invention.

The preferred embodiments of the present invention will now be described with reference to FIGS. 1–12, wherein like components are designated by like reference numerals throughout the various figures. The present invention is directed to CMP methods and apparatus that can operate at high bi-directional linear pad or reciprocating speeds and a reduced foot-print. The high bi-directional linear pad speeds optimize planarity efficiency while the reduced foot-print reduces the cost of the polishing station. Further, because the polishing pad is adapted to travel in bi-directional linear directions, this reduces the pad glazing effect, which is a common problem in conventional CMP polishers. Because the pad travels in bi-directional linear directions, the pad (or pad attached to a carrier) is substantially self-conditioning.

Figure 2:
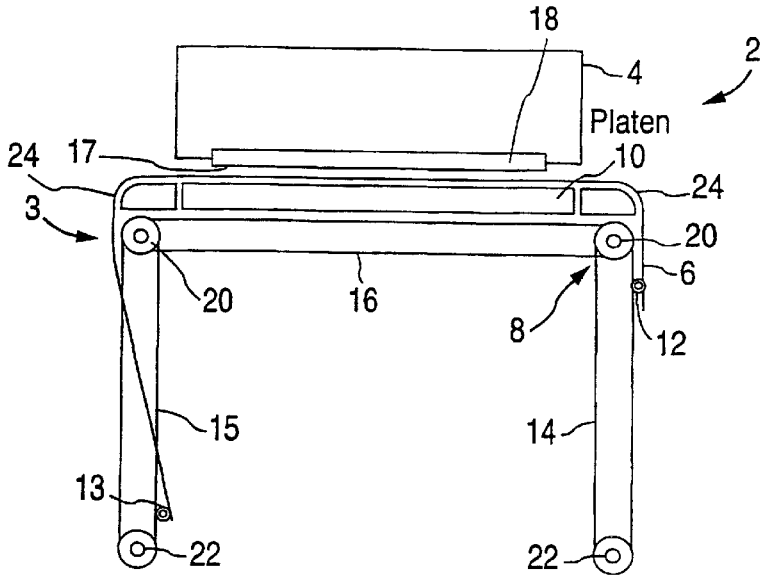
FIG. 2 illustrates a side view of a polishing method and apparatus in accordance with the first preferred embodiment of the present invention.

FIG. 1 illustrates a perspective view and FIG. 2 illustrates a side view of an apparatus of a first preferred embodiment of the present invention. The wafer polishing station 2 includes a bi-directional linear, or reverse linear, polisher 3 and a wafer housing 4. The wafer housing 4, which can rotate about its center axis and/or move side to side or vertically, securely positions a wafer 18 or workpiece so that a surface 17 may be polished. In accordance with the present invention, novel methods and apparatus of loading and unloading the wafer 18 onto the wafer housing 4 is described more fully later herein.

The reverse linear polisher 3 includes a polishing pad 6 for polishing the wafer surface 17, a mechanism 8 for driving the polishing pad 6 in a bi-directional linear or reciprocating (forward and reverse) motion, and a support plate 10 for supporting the pad 6 as the pad 6 polishes the wafer surface 17. A polishing agent or slurry containing a chemical that oxidizes and mechanically removes a wafer layer is flowed between the wafer 18 and the polishing pad 6. The polishing agent or slurry such as colloidal silica or fumed silica is generally used. The polishing agent or slurry generally grows a thin layer of silicon dioxide or oxide on the wafer surface 17, and the buffering action of the polishing pad 6 mechanically removes the oxide. As a result, high profiles on the wafer surface 17 are removed until an extremely flat surface is achieved. It should also be noted that the size of the particles from the polishing agent or slurry used to polish the wafer surface 17 is preferably at least two or three times larger than the feature size of the wafer surface 17. For example, if the feature size of the wafer surface 17 is 1 micron, then the size of the particles should be at least 2 or 3 microns.

The underside of the polishing pad 6 is attached to a flexible but firm and flat material (not shown) for supporting the pad 6. The polishing pad 6 is generally a stiff polyurethane material, although other suitable materials may be used that is capable of polishing wafer surface 17. In addition, the polishing pad 6 may be non-abrasive or abrasive, depending on the desired polishing effect and chemical solution used.

In accordance with the first preferred embodiment of the present invention, the driving or transmission mechanism 8 for driving the polishing pad 6 in a bi-directional linear motion will now be described. Although FIGS. 1–2 illustrate only one driving mechanism 8 from the front side of the reverse linear polisher 3, it is understood that on the backside of the reverse linear polisher 3, a similar driving mechanism 8 is also present. Driving mechanism 8 includes three timing belts, two vertically suspending timing belts 14, 15 and one horizontally suspending timing belt 16. The timing belts 14, 15, and 16 may be formed of any suitable material such as stainless steel or high strength polymers having sufficient strength to withstand the load applied to the belts by the wafer 18. One end of the vertically suspending timing belts 14, 15 is secured to rollers 20 while the other end is secured to rollers 22. Likewise, each end of the horizontally suspending timing belt 16 is secured to rollers 20. As illustrated in FIG. 1, it is noted that the horizontally suspending timing belt 16 is placed in a z-plane slightly outside the z-plane of the vertically suspending timing belts 14, 15.

Rollers 20 link the two vertically suspending timing belts 14, 15 with the horizontally suspending timing belt 16 so that each belts rate of rotation depends on the rate of rotation of the other belts. The rollers 20 and 22 retain the timing belts 14, 15, and 16 under proper tension so that the polishing pad 6 is sufficiently rigid to uniformly polish the wafer surface 17. The tension of the timing belts may be increased or decreased as needed by adjusting the position of rollers 22 relative to roller 20.

Although the present invention describes a driving mechanism having three timing belts secured on four rollers, it is understood that any suitable number of rollers and/or timing belts, or a driving mechanism that does not rely on rollers/belts, i.e. a seesaw mechanism, such that it provides the bi-directional linear or reciprocating motion, are intended to be within the scope and spirit of the present invention.

An important aspect of the present invention is that the polishing pad 6 and the corresponding support material is adapted to bend at an angle at corners 24, which angle is preferably about 90°. Each end of the polishing pad 6 is attached to a point on the two vertically positioned timing belts 14, 15 by attachments 12, 13. One end of the polishing pad 6 is secured to attachment 12, and the other end is secured to attachment 13. Attachments 12 and 13 are preferably a sleeve and rod, as more fully described later herein. Referring again to FIGS. 1 and 2, as one end of the polishing pad 6 travels vertically downward with the assistance of timing belt 14 and attachment 12, the other end of the polishing pad 6 travels vertically upward with the assistance of timing belt 15 and attachment 13. The mechanical alignment of the timing belts 14, 15, and 16 with the rollers 20 and 22 allows such movement to occur.

In order to drive the timing belts 14, 15, and 16 to a desired speed, a conventional motor (not shown) is used to rotate rollers 20 and/or 22. The motor is connected to rollers 20 or 22 or to any suitable element connected to rollers 20 and/or 22, and it provides the necessary torque to rotate rollers 20 and 22 to a desired rate of rotation. The motor directly/indirectly causes rollers 20 and 22 to rotate so that the timing belts 14, 15, and 16 are driven at a desired speed in both forward and reverse directions. For instance, when attachment 13 reaches roller 22 during its downward motion, it will reverse the direction of the polishing pad 6 as attachment 13 now travels upward. Soon thereafter, the same attachment 13 now reaches roller 20 and again changes direction in a downward direction. The reciprocating movement of attachment 13 allows the polishing pad 6 to move in both forward and reverse directions. Preferably, the speed at which the polishing pad 6 is moved is within the range of approximately 100 to 600 feet per minute for optimum planarization of the wafer surface 17. However, it should be understood that the speed of the polishing pad 6 may vary depending on many factors (size of wafer, type of pad, chemical composition of slurry, etc.). Further, the pad 6 may be moved in both bi-directional linear directions at a predetermined speed, which preferably averages between 100 to 600 feet per minute.

Figure 3:
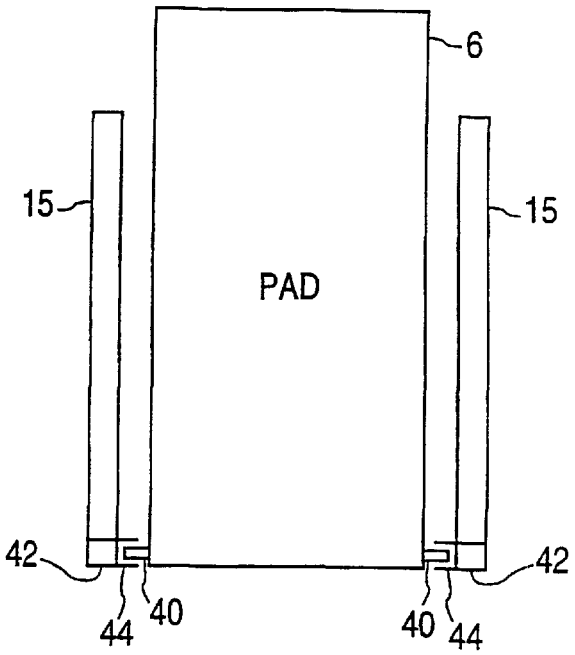
FIG. 3 illustrates a front view of a method and apparatus for attaching a polishing pad to timing belts in accordance with the first preferred embodiment of the present invention.
Figure 4:
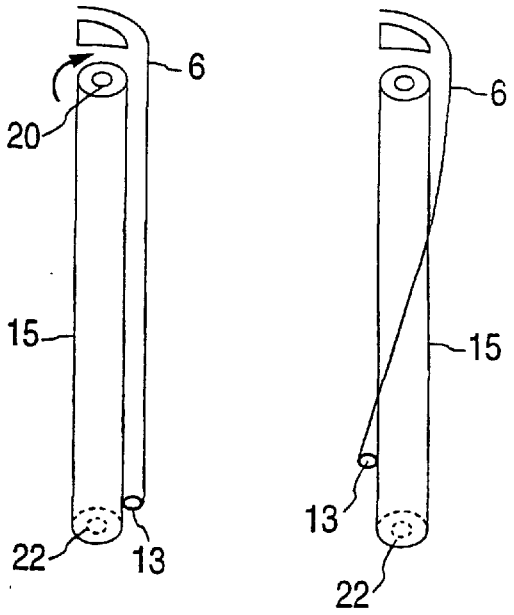
FIG. 4 illustrates side views of a polishing pad moving around the timing belt rollers in accordance with the first preferred embodiment of the present invention.

FIG. 3 illustrates a front view and FIG. 4 illustrates a side view of a method and apparatus for attaching the polishing pad 6 to the timing belts 14, 15 in accordance with the first preferred embodiment of the present invention. As described earlier herein, the underside of the polishing pad 6 is attached to the flexible but firm and flat material, which is non-stretchable. At each end of the material, and thus the ends of the polishing pad 6, a rod 40 is attached. The rod 40 extends horizontally from the pad 6 as shown in FIG. 3. A sleeve 42, i.e. a cylinder or a slit, is also attached to each of the vertically suspending timing belts 14, 15, and a portion 44 of the sleeve 42 extends horizontally to join the rod 40, as again illustrated in FIG. 3. When the rod 40 and the sleeve 42 are joined, this allows the polishing pad 6 to travel bi-directional with high linear speeds without the problem of having the polishing pad 6 being wrapped around the rollers 20, 22. FIG. 4 further illustrates a side view of the polishing pad 6 as it rotates around the rollers 20, 22.

As described earlier, the polishing pad 6 bends at an angle, preferably about 90° at the two corners 24. This approach is beneficial for various reasons. In accordance with the present invention, the length of the polishing pad 6 on the horizontal plane needed to polish the wafer surface 17 needs to be only slightly longer than the wafer 18 diameter. Optimally, the entire length of polishing pad should be only slightly longer than three times the wafer 18 diameter. This allows the most efficient and economical use of the entire polishing pad 6. During polishing, slurry or other agent may be applied to the portions of the polishing pad 6 that are not in contact with the wafer surface 17. The slurry or other agent can be applied to the polishing pad preferably at locations near corners 24. The configuration of the polishing pad 6 described above also decreases the size of a support plate 10 needed to support the pad 6. Furthermore, though the bi-directional linear movement provides for a substantially self conditioning pad, a conditioning member can also be disposed on or about this same location.

The novel approach described above has many other advantages and benefits. For example, the CMP device of the present invention takes up less space than most traditional CMP devices because about two-thirds of the polishing pad 6 can be in a vertical position. The bi-directional linear movement of the CMP device further increases the pad usage efficiency because the reciprocating movement of the pad 6 provides a self-conditioning function, since the pad 6 is moving in different, preferably opposite, directions.

In accordance with the present invention, only one wafer is generally polished during a single time. As described above, the polishing pad 6 moves bi-directional with high linear speeds so as to uniformly polish the wafer surface 17. Because high pad speeds are needed to polish the wafer surface 17, the momentum, and thus inertia created is very high. Thus, as the polishing pad 6 reverses direction, sufficient energy is needed to keep the pad moving at desired speeds. If the total area (length and width) of the polishing pad 6 is minimized, the energy needed to keep the pad moving at desired speeds is decreased accordingly. Thus, by limiting the length of the polishing pad 6, a conventional motor can handle the necessary energy needed to keep the pad moving at desired speeds in both forward and reverse directions. The entire length of the polishing pad 6 should be slightly longer than two-diameter lengths of the wafer 18, and preferably three-diameter lengths of the wafer 18. The reason for this is so that the polishing pad 6 may be conditioned and slurry may be applied to both sides of the pad opposite where the wafer 18 is positioned, in close proximity to corners 24. Also, although it is preferred that the polishing pad 6 width is wider than the wafer diameter, in other embodiments, the width of the polishing pad 6 may be smaller than the wafer diameter.

Although the present invention is adapted to polish a single wafer at one time, one skilled in the art may modify the preferred embodiment of the invention in order to polish multiple wafers at one time. Slurry (not shown) can be applied to the surface of the polishing pad 6 in conventional manners and the pad 6 can further be conditioned in conventional manners.

Referring again to FIGS. 1–2, the support plate 10 for supporting the polishing pad 6 will now be described. The polishing pad 6 is held against the wafer surface 17 with the support of the support plate 10, which may be coated with a magnetic film. The backside of the support material to which the polishing pad 6 is attached may also be coated with a magnetic film, thus causing the polishing pad 6 to levitate off the support plate 10 while it moves at a desired speed. It should be understood that other conventional methods can be used to levitate the polishing pad 6 off the support plate 10 while it polishes the wafer surface 17, such as air, magnetic, lubricant, and/or other suitable liquids.

Figure 5:
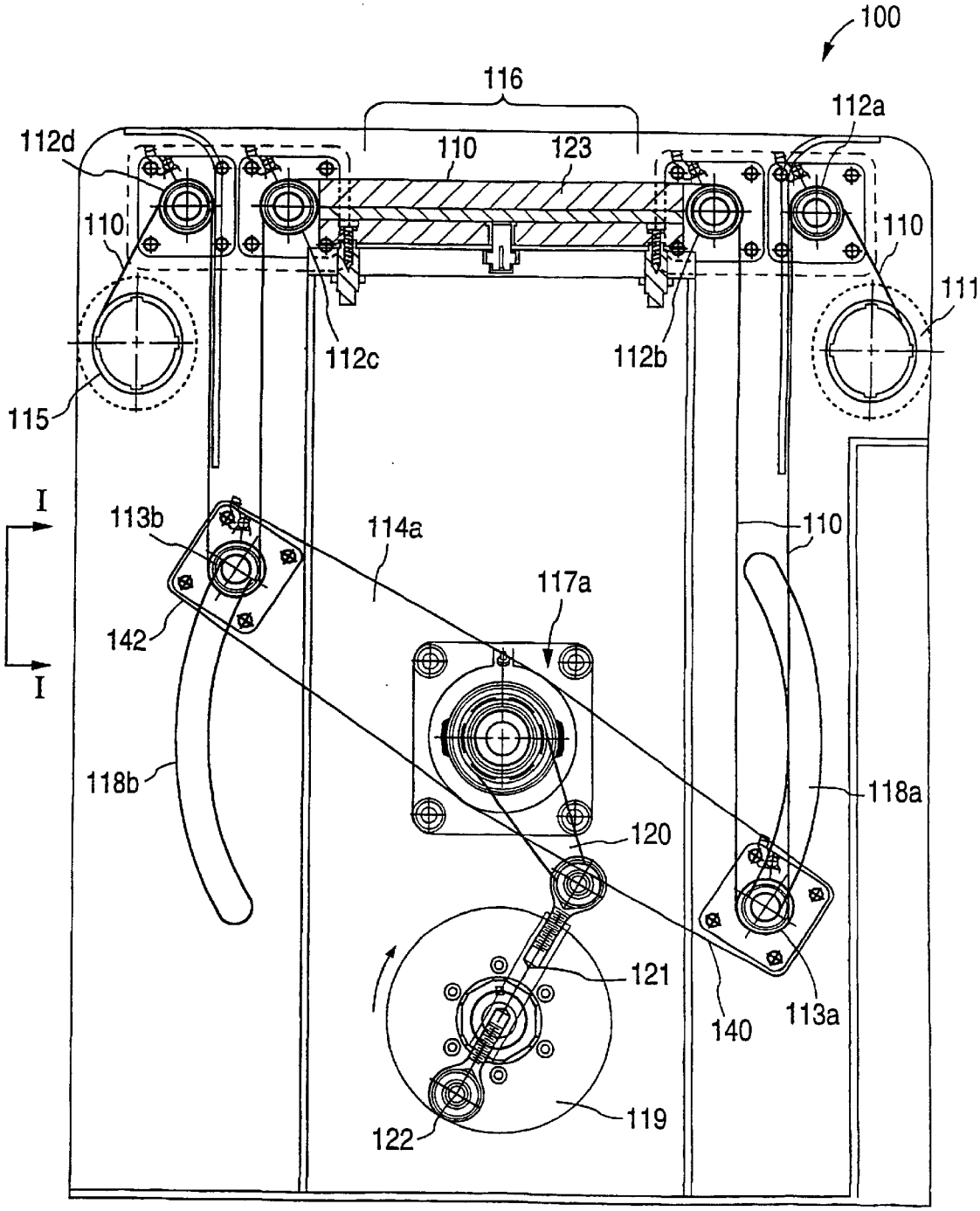
FIG. 5 illustrates a side view of a polishing apparatus and driving mechanism in accordance with the second preferred embodiment of the present invention.
Figure 6:
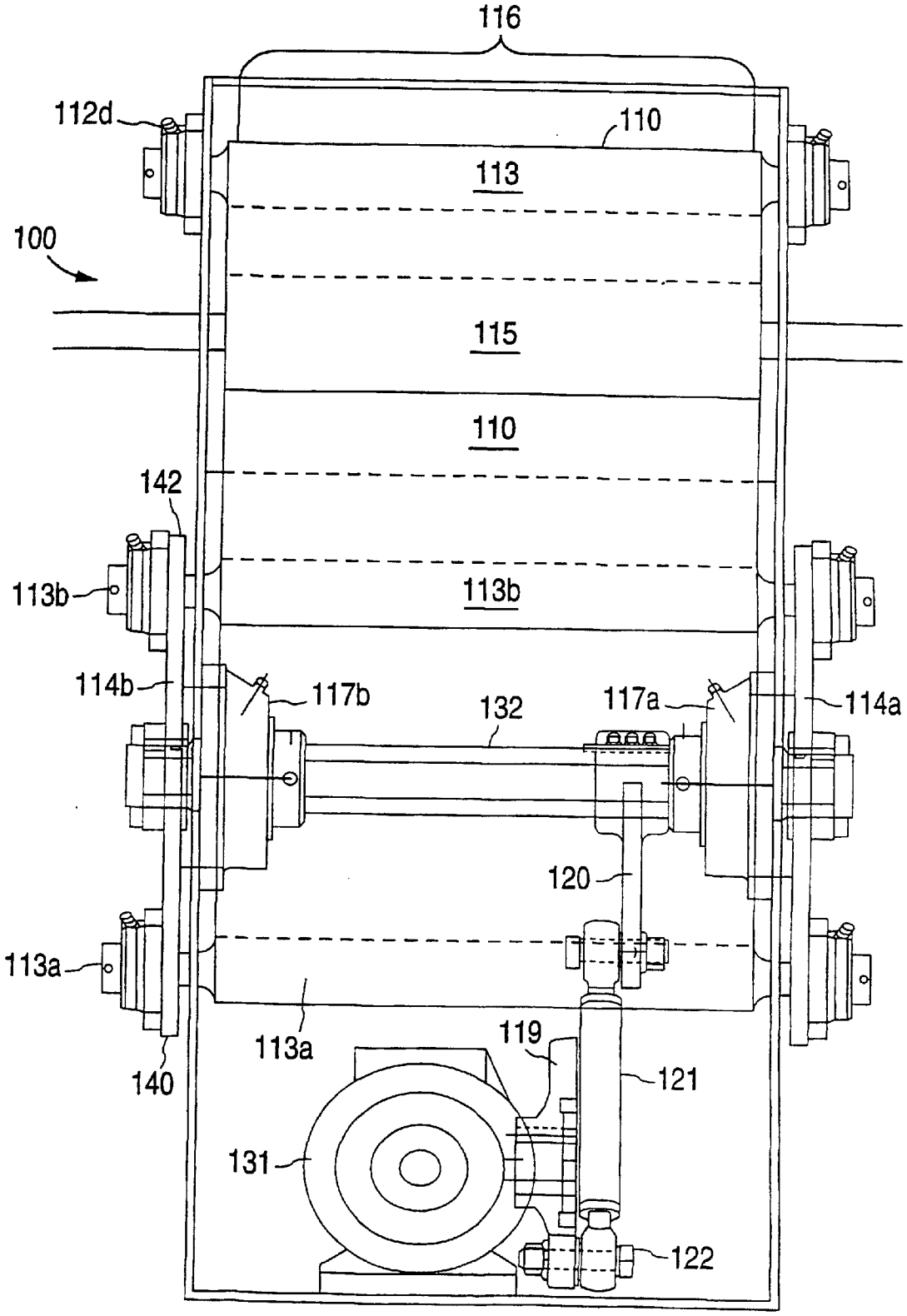
FIG. 6 illustrates a cross sectional view of the polishing apparatus and driving mechanism of FIG. 5 in accordance with the second preferred embodiment of the present invention.

FIGS. 5 and 6 illustrate side and cross sectional views (along line I—I), respectively, of a polishing apparatus and driving mechanism in accordance with the second preferred embodiment of the present invention. Reference will be made concurrently to FIGS. 5 and 6 for a more complete understanding of the second preferred embodiment of the present invention.

The polishing apparatus 100 includes a driving mechanism having a bi-directional linear, or reverse linear, polishing belt 110 for polishing a wafer (not shown) that is supported by the wafer housing 4 (not shown), which is described in greater detail later herein. A processing area 116 of the apparatus 100 includes a section of the polishing belt 110 that is supported by a platen 123, which platen 123 is capable of providing "gimbaling" action for leveling/suspending the section of the polishing belt 110 above it. In addition, an air or magnetic bearing may be positioned underneath the section of the polishing belt 110 in the processing area 116 to control the pressure between the polishing belt 110 and the wafer surface during the polishing process.

Besides the processing area 116, the polishing apparatus 100 includes in its top portion a supply spool 111, a receiving spool 115, and idle rollers 112*a*, 112*b*, 112*c*, 112*d*. In addition, the apparatus 100 includes a pair of rocker arms 114*a*, 114*b*, each having rocker bearings 117*a*, 117*b*, respectively, connected thereto via a shaft 132. Further connected to each end of the rocker arms 114*a*, 114*b* are a pair of rocker arm rollers 113*a*, 113*b*, which are capable of moving about within the railings 118*a*, 118*b*, respectively. The shaft 132 connecting the pair of rocker arms 114*a*, 114*b* is further connected to a drive crank 119 through an elbow 120 and a connecting rod 121. As shown, the connecting rod 121 can be fixed to the drive crank 119 at position 122. Additionally, a first motor 131 is connected to the drive crank 119 for rotating the same, which operation is described in greater detail below.

During operation in accordance with the second preferred embodiment, the polishing belt 110 originates from the supply spool 111 to a first idle roller 112*a*. Although not expressly illustrated, a conventional clutch mechanism is connected to the supply spool 111, which is used to adjust the tension of the polishing belt 110 between the supply spool 111 and the receiving spool 115. The polishing belt 110 is then routed around the first idle roller 112*a* and a first rocker arm roller 113*a* to a second idle roller 112*b*. The polishing belt 110 is again routed around the second idle roller 112*b* to a third idle roller 112*c*. Thereafter, the polishing belt 110 is routed around a second rocker arm roller 113*b* and a fourth idle roller 112*d* to the receiving spool 115.

A second conventional motor (not shown) is connected to the receiving spool 115 for rotating the same so that sections of the polishing belt 110 can be pulled from the supply spool 111 to the receiving spool 115. For example, when the second motor is activated and the clutch resistance is properly adjusted, the second motor rotates the receiving spool 111 in a manner such that sections of the polishing belt 110 are received therein. In a similar manner, the tension of the polishing belt 110 between the supply spool 111 and receiving spool 115 can be adjusted by providing the appropriate motor torque and clutch resistance. This technique can be used to provide the proper contact pressure between the polishing belt 110 and the wafer surface in the processing area 116.

When a section of the polishing belt 110 is positioned in the processing area 116, the first motor 131 can be activated to rotate the drive crank 119 in a circular manner. This in turn allows the connecting rod 121 to push the elbow 20 upwards, thereby moving the right section 140 of the rocker arm 114 upwards. This allows the first rocker arm roller 113*a* to move upwards (from the position as illustrated in FIG. 5) along the right railing 118*a*. Simultaneously, this causes the second rocker arm roller 113*b* on the left section 142 of the rocker arm 114 to move downwards along the left railing 118*b*. Thus, as the drive crank 119 is continuously rotated, the first and second rocker arm rollers 113*a*, 113*b* continue to move up and down along right and left railings 118*a*, 118*b*, respectively, thereby causing the section of the polishing belt 110 in the processing area 116 to move in the bi-directional or reverse linear motion. Polishing chemicals (i.e., slurry) such as those described above are provided between the polishing belt 110 and the wafer surface.

After the section of the polishing belt 110 is used to polish one or more wafers in the processing area 116, a new section of the polishing belt 110 is fed to the processing area 116 in the manner described above. In this manner, after one section of the polishing belt 110 is worn out, damaged, etc., the new section can be used. Consequently, using the present invention, all or most sections of the polishing belt 110 in the supply spool 111 will be used.

Although the second preferred embodiment describes an apparatus and driving mechanism having four idle rollers, two rockers arm rollers, two rocker arms, etc., it is understood that any suitable number of idle rollers, rocker arm rollers, rocker arms, etc., can be used to provide the bi-directional linear or reciprocating motion and is intended to be within the spirit and scope of the present invention. In addition, other similar components/devices may be substituted for the ones described above.

In addition, the layout or geometry of the polishing pad/belt with respect to the wafer as illustrated in the first and second embodiments can be changed from those illustrated herein to other positions. For example, one can position the polishing pad/belt above the wafer, position the polishing pad/belt vertically with respect to the wafer, etc.

Figure 7:
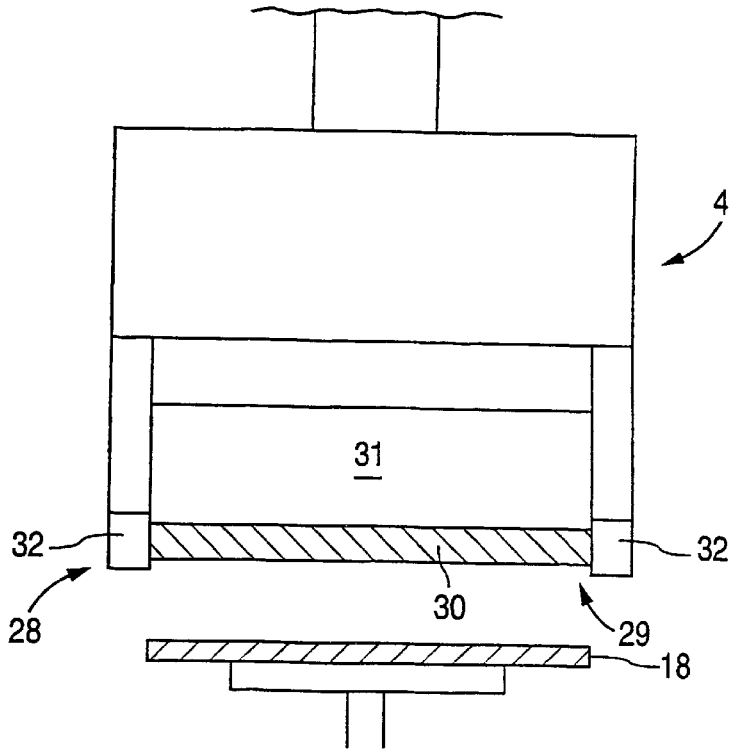
FIG. 7 illustrates a side view of a wafer housing adapted to load and unload a wafer onto the housing in accordance with the preferred embodiment of the present invention.

Next, with reference to FIG. 7, a wafer housing 4 in accordance with the preferred embodiment of the present invention will now be described. Wafer housing 4 includes a nonconductive, preferably circular, head assembly 28 with a cavity 29 that is preferably a few millimeters deep at its center and having a resting pad 30 thereof. The wafer 18 is loaded into the cavity 29, backside first, against the resting pad 30. A conventional type of securing mechanism 31 (i.e. vacuum) is used to ensure that the wafer 18 is securely positioned with respect to the wafer head assembly 28 while the wafer 18 is being polished. The resting pad 30 may also be of a type that secures the wafer 18 by suctioning the backside of wafer 18 when the resting pad 30 is wet.

As described above, the reverse linear polisher 3 or polishing belt 110 may polish the wafer 18 during various stages of the wafer fabrication process. Accordingly, a method for loading the wafer 18 into the cavity 29 so that an additional loading mechanism is not needed will now be described with reference to FIG. 8. First, the wafer housing 4 is aligned to load the wafer 18 into the cavity 29. The head assembly 28 includes a pin housing 32 adapted to move up and down with respect to the cavity 29 using a motor or pneumatic control (not shown). During loading of the wafer 18, the pin housing 32 extends down from an original position, which is illustrated by the dashed lines, below the surface 17 of the wafer 18. At least three pins 34 are then automatically caused to protrude out of the pin housing 32 using a conventional retraction device under motor control so that the wafer 18 can be picked up and loaded into the cavity 29 of the head assembly 28. With the pins 34 protruding out, the pin housing 32 automatically retracts back to its original position, and thus the wafer 18 is loaded into cavity 29. When the head assembly 28 and the resting pad 30 secures the position of the wafer 18, as described above, the pins 34 automatically retract back into the pin housing 32 and the pin housing 32 retracts back to its original position so that the wafer 18 may be polished, as illustrated in FIG. 9.

Referring back to FIGS. 1 and 2, after the wafer 18 is securely loaded onto the wafer housing 4, the wafer housing 4 is automatically lowered until the wafer surface 17 is in contact with the polishing pad 6. The polishing pad 6 polishes the wafer surface 17 in accordance with the method described herein; the wafer 18 is then ready to be unloaded from the wafer housing 4.

Figure 8:
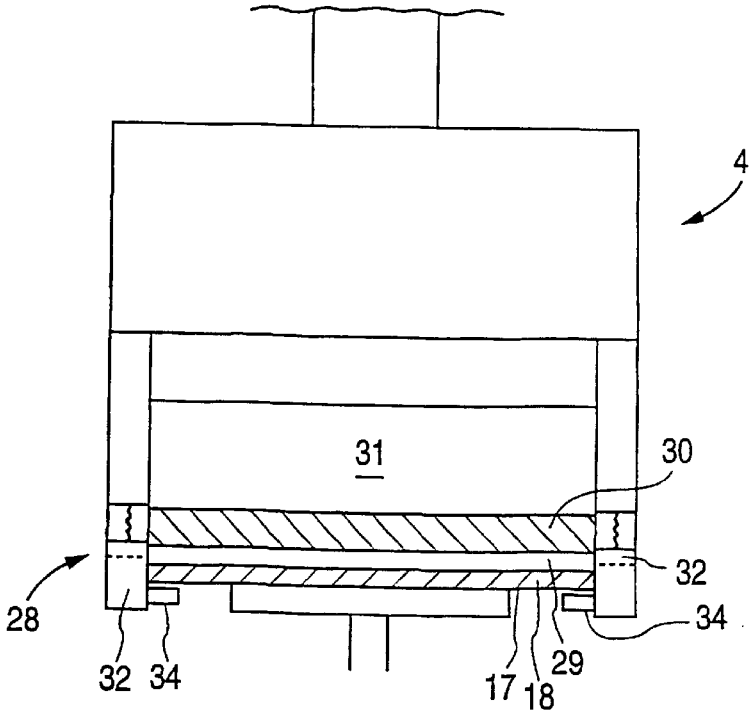
FIG. 8 illustrates a side view of a wafer housing having protruding pins adapted to load/unload a wafer onto the housing in accordance with the preferred embodiment of the present invention.
Figure 9:
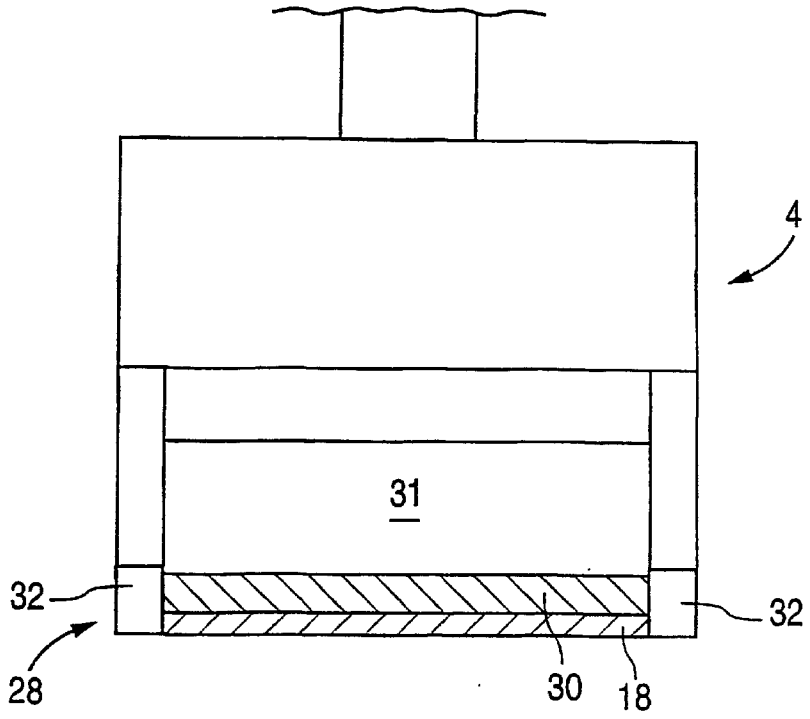
FIG. 9 illustrates a side view of a wafer loaded onto a wafer housing in accordance with the preferred embodiment of the present invention.

With reference to FIG. 8, the wafer 18 is unloaded from the wafer housing 4 using essentially a reverse order of the loading steps. After polishing the wafer 18, the wafer housing 4 is raised from the polishing pad 6, and the pin housing 32 extends down from its original position, which is illustrated by the dashed lines, below the surface 17 of the wafer 18. The pins 34 are then automatically caused to protrude out so that the wafer 18 may be supported when unloaded from the cavity 29. With the pins 34 protruding, the vacuum is reversed with opposite air flow, thus dropping the wafer 18 away from head assembly 28 and onto the pins 34 (i.e., wafer 18 is positioned from the resting pad 30 onto the pins 34). From this position, the wafer can then be transported to the next fabrication processing station.

Figure 10:
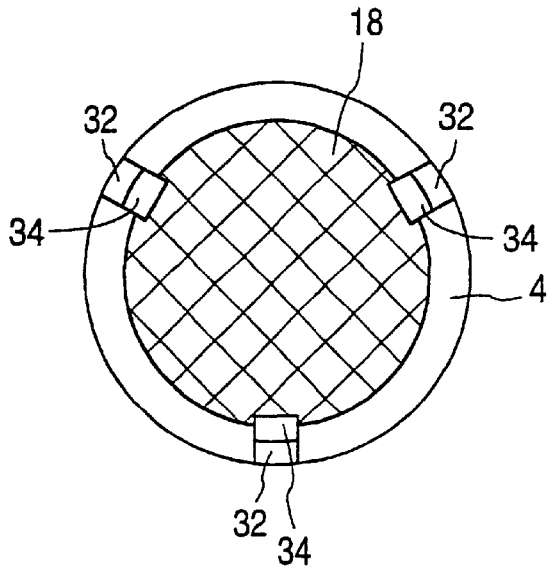
FIG. 10 illustrates a bottom view of a wafer being loaded and unloaded onto a wafer housing by three pins in accordance with the preferred embodiment of the present invention.

FIG. 10 illustrates a bottom view of the wafer 18 surface being loaded and unloaded into the cavity 29 by the pins 34. Although FIG. 10 illustrates three protruding pins 34, it should be understood that more than three pins, or an alternative support mechanism, may be used in accordance with the present invention.

Figure 11:
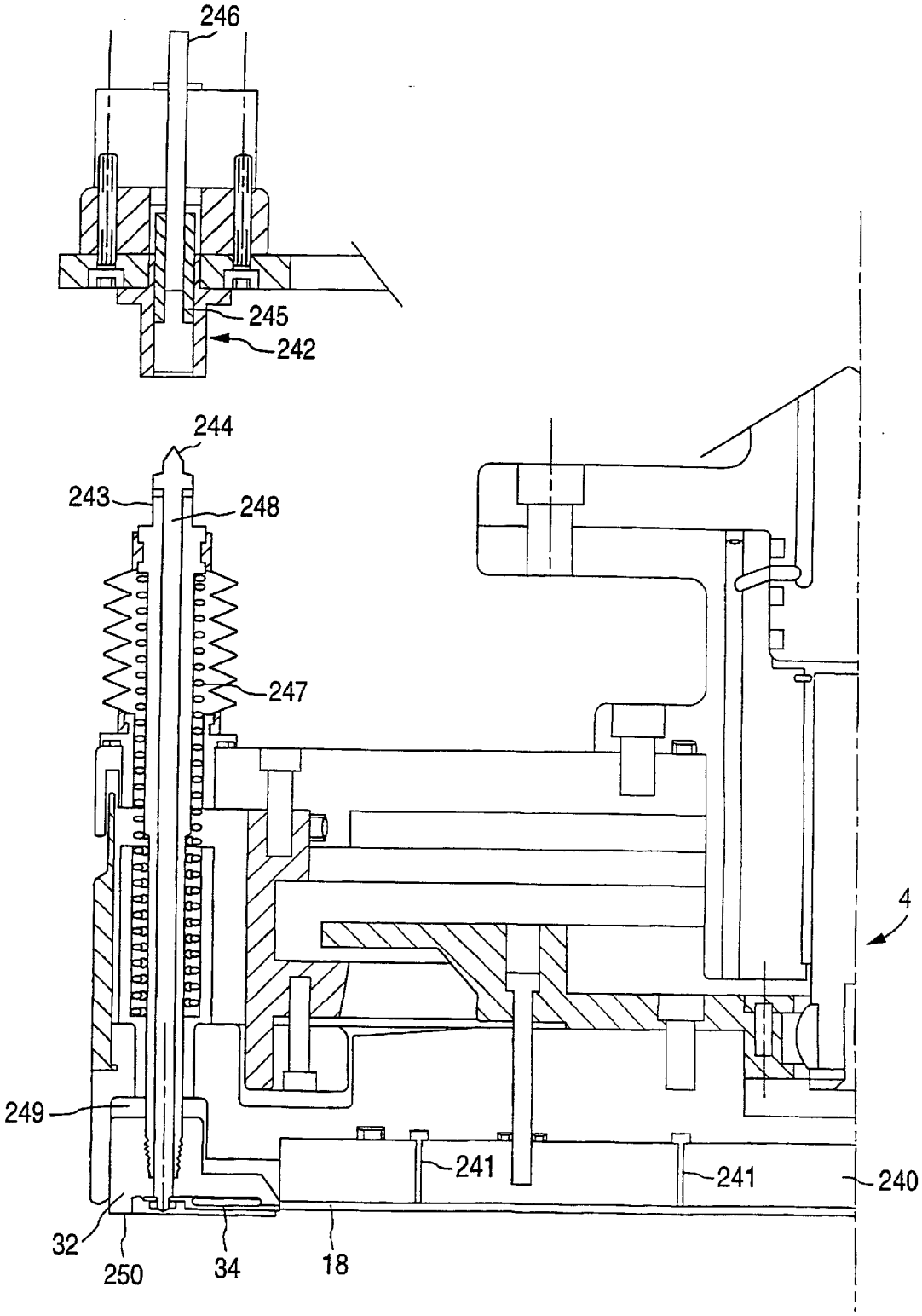
FIG. 11 illustrates an exploded cross sectional view of a wafer housing and a loading/unloading mechanism in accordance with the preferred embodiment of the present invention.

FIG. 11 illustrates an exploded cross sectional view of a wafer housing and a loading/unloading mechanism in accordance with the preferred embodiment of the present invention. It is noted that FIG. 11 illustrates only one section (i.e., left section) of the wafer housing 4 having the wafer 18 loaded thereon.

In greater detail, the wafer 18 is loaded onto a resting plate 240 having a resting pad (not shown, but similar to the resting pad 30 of FIGS. 7–9) attached thereon for providing a cushion to the backside of the wafer 18. After the wafer 18 is loaded onto the resting pad using the pins 34, the securing mechanism, such as a vacuum, suctions the wafer 18 on the pad via holes 241.

A pin assembly described herein allows the pin housing 32 to move up and down and the pin 34 to rotate in a circular motion. For example, during operation, a rotary cylinder 242 having an engagement sleeve 245 and a shaft 246 is used to provide the proper movement of the pin housing 32 and pin 34. When the rotary cylinder 242 is lowered towards a push rod 243, a tip 244 of the push rod 243 is fitted snuggly into the engagement sleeve 245. When an appropriate force is used to push down the rotary cylinder 242, the push rod 243 and consequently, the pin 34 are pushed downward. When the pin 34 is separated from the wafer 18, the wafer 18 is supported only by the securing mechanism.

Thereafter, the shaft 246 and the engagement sleeve 245 can be rotated about 90 degrees in order to rotate a core shaft 248 of the push rod 243. When the core shaft 248 is rotated, the pin 34, which is connected to the end of the core shaft 248, is likewise rotated about 90 degrees. When the pin 34 is rotated away from the wafer 18, the rotary cylinder 242 can be moved upwards. This movement causes the pin housing 32 to also move upwards, thereby eliminating the gap 249 between the pin housing 32 and the other sections of the wafer housing 4.

The dimensions of the components selected for use in this embodiment are such that when the pin housing 32 moves upwards and the gap 249 is eliminated, the lower surface 250 of the pin housing 32 is higher than the lower surface of the wafer 18. Stated alternatively, when the lower surface of the wafer 18 is brought into contact with a polishing pad underneath the wafer housing 4, the lower surface of the wafer 18 makes initial contact with the polishing pad, while the pin housing 32 does not. The pin housing 32 is also used as a retaining device for preventing horizontal movement of the wafer 18.

Figure 12:
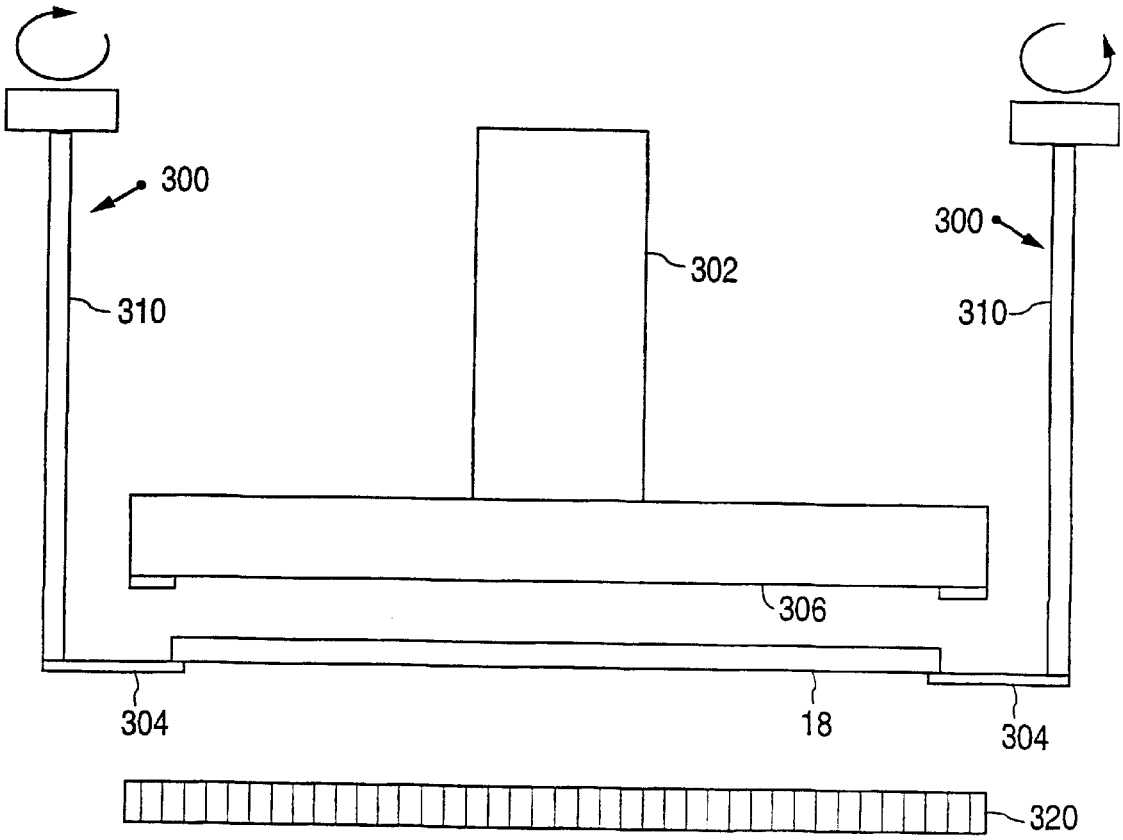
FIG. 12 illustrates a cross sectional view of yet another embodiment of a wafer housing and a loading/unloading mechanism in accordance with the preferred embodiment of the present invention.

FIG. 12 illustrates a cross sectional view of yet another embodiment of a wafer housing and a loading/unloading mechanism in accordance with the preferred embodiment of the present invention. Unlike the previous embodiments, the loading/unloading mechanism 300 of this embodiment is a device that is separate and unattached to a wafer housing 302. For example, during loading, the pins 304 are rotated to the proper position so that they can support the wafer 18. The wafer housing 302 is then move downwards (and/or the loading/unloading mechanism can be moved upwards) such that the wafer 18 is placed in the cavity 306. A securing mechanism, as discussed above, is then used to support the wafer 18. Thereafter, the pins 304 are rotated away from the wafer 18 using the rotary shafts 310 so that the wafer 18 can be polished using a polishing pad 320.

It is to be understood that in the foregoing discussion and appended claims, the terms "wafer surface" and "surface of the wafer" include, but are not limited to, the surface of the wafer prior to processing and the surface of any layer formed on the wafer, including conductors, oxidized metals, oxides, spin-on glass, ceramics, etc.

Although various preferred embodiments of the present invention have been disclosed for illustrative purposes, those skilled in the art will appreciate that various modifications, additions and/or substitutions are possible without departing from the scope and spirit of the present invention as disclosed in the claims.

We claim:

1. A polishing apparatus adapted to polish a surface of a wafer, comprising:

a supply spool and a receiving spool;

a polishing belt having two ends, wherein one end is attached to the supply spool and the other end is attached to the receiving spool;

a processing area having a section of the polishing belt in between the two ends; and means for moving the section of the polishing belt in a bi-directional linear motion.

2. A polishing apparatus of claim 1, wherein the means for moving the section of the polishing belt includes:

a plurality of idle rollers adapted to route the polishing belt;

a plurality of movable rollers adapted to move about within a plurality of railings and adapted to route the polishing belt;

one or more rocker arms connected to the plurality of movable rollers and adapted to move the plurality of movable rollers in a simultaneous manner; and a drive crank connected to the one or more rocker arms through a rod.

3. A polishing apparatus of claim 1 further comprising a wafer housing for supporting the wafer.

4. A polishing apparatus of claim 1 further comprising a support plate adapted to support the polishing belt as the section of the belt polishes the surface of the wafer.

5. A polishing apparatus of claim 4 further comprising an air bearing in between the polishing belt and the support plate.

6. A polishing apparatus of claim 4 further comprising a magnetic bearing in between the polishing belt and the support plate.

7. A method of polishing a surface of a wafer, comprising:

supporting the wafer such that the surface of the wafer is exposed to a section of a polishing belt in a processing area; and polishing the surface of the wafer by moving the section of the polishing belt bi-directional linearly.

8. A method according to claim 7, wherein the polishing belt is moved with a driving mechanism that generates the bi-directional linear movement.

9. A method according to claim 8, wherein the driving mechanism includes:

a plurality of idle rollers adapted to route the polishing belt;

a plurality of movable rollers adapted to move about within a plurality of railings and adapted to route the polishing belt;

one or more rocker arms connected to the plurality of movable rollers and adapted to move the plurality of movable rollers in a simultaneous manner; and a drive crank connected to the one or more rocker arms through a rod for moving the one or more rocker arms.

10. A method according to claim 2, wherein the supporting step further comprising securing the wafer in a wafer housing.

11. A method of providing bi-directional linear polishing comprising the steps of:

providing a polishing belt between a supply area and a receive area, the polishing belt having a first end and a second end and a polishing side and a backside, such that the first end initially comes off the supply area and is connected to the receive area and the second end remains connected to the supply area;

polishing by bi-directionally linearly moving a portion of the polishing belt within a polishing area;

advancing the polishing belt to obtain another portion that will be used for polishing;

polishing by bi-directionally linearly moving the another portion of the polishing belt; and repeating the steps of advancing and polishing using another portion.

12. The method according to claim 11 further including the steps of:

introducing a first workpiece to the polishing area prior to polishing using the portion of the polishing belt:

removing the first workpiece when polishing of the first workpiece is completed; and introducing a second workpiece to the polishing area prior to polishing using the another portion of the polishing belt.

13. The method according to claim 12 wherein the steps of introducing include the steps of:

loading the first workpiece onto a loading mechanism disposed in close proximity to a workpiece holder;

causing the workpiece to become attached to the workpiece holder;

retracting the loading mechanism so that the workpiece can be polished in the step of polishing; and causing the workpiece holder to establish and maintain contact between the workpiece and the portion of the polishing belt within the polishing area.

14. The method according to claim 11 wherein during the step of polishing, there is also included the step of tensioning the portion of the polishing belt within the polishing area.

15. The method according to claim 11, wherein the step of providing causes the polishing belt to contact a plurality of rollers disposed between the supply area and the receive area.

16. The method according to claim 15 wherein the steps of polishing with the portion of the polishing belt includes the steps of:

causing a first plurality of rollers to reciprocate vertically, thereby causing the portion to move bi-directionally linearly; and causing a second plurality of rollers to rotate about a stationary axis, thereby providing the polishing area therebetween; and maintaining contact between a workpiece with the portion of the polishing belt within the polishing area.

17. The method according to claim 16 wherein the steps of polishing with the another portion of the polishing belt includes the steps of:

causing the first plurality of rollers to reciprocate vertically, thereby causing the portion to move bi-directionally linearly; and causing the second plurality of rollers to rotate about the stationary axis, thereby providing the polishing area therebetween; and maintaining contact between another workpiece with the another portion of the polishing belt within the polishing area.

18. The method according to claim 16 wherein the step of causing the first plurality of rollers to reciprocate vertically results in at least one roller moving vertically in one direction when at least another roller is moving vertically in an opposite direction.

19. The method according to claim 11 wherein the step of advancing advances to the another portion such that there is no overlap between the portion and the another portion.

20. The method according to claim 11 wherein during the step of advancing a previously used portion is received into the receive area and a new portion comes off the supply area.

21. The method according to claim 11 wherein the steps of polishing perform abrasive polishing.

22. The method according to claim 11 wherein the steps of polishing perform non-abrasive polishing.

23. The method according to claim 11 wherein, during the steps of polishing, there is simultaneously occuring a step of providing a force to the backside of the polishing belt within the polishing area.

24. The method according to claim 23 wherein the step of providing the force applies air.

25. The method according to claim 11 wherein the steps of polishing use a polishing belt that has a width greater than a width of a workpiece being operated upon.

26. The method according to claim 11 wherein the steps of polishing use a polishing belt that has a width less than a width of a workpiece being operated upon.

27. A polishing apparatus adapted to polish using a polishing belt having a first end and a second end and a polishing side and a backside, comprising:

a receive area to which the first end of the polishing belt can be connected;

a supply area to which the second end of the polishing belt can be connected;

a support structure that provides a path for the polishing belt to travel between the receive area and the supply area, such that a workpiece processing area exists along the path;

a first drive mechanism that is capable of bi-directionally linearly polishing by bi-directionally linearly moving a portion of the polishing belt within the processing area; and a second drive mechanism that provides for advancing the polishing belt, such that another portion of the polishing belt can be located within the processing area and used for bidirectional linearly polishing by bi-directionally linearly moving the another portion of the polishing belt within the processing area.

28. The apparatus of claim 27 further including:

a workpiece holder that assists in maintaining contact between the workpiece and the polishing area of the polishing belt; and a loading mechanism disposed in close proximity to the workpiece holder that assists in loading the workpiece onto the workpiece holder.

29. The apparatus according to claim 28 wherein the loading mechanism includes:

a plurality of retractable housings, each retractable housing containing a plurality of retractable pins, such that the workpiece can be loaded onto the plurality of retractable pins when the retractable pins are oriented to load the workpiece.

30. The apparatus according to claim 28 wherein the loading mechanism is not attached to the workpiece holder.

31. The apparatus according to claim 28 wherein the loading mechanism is integral with the workpiece holder.

32. The apparatus according to claim 31 wherein the loading mechanism is disposed on the workpiece holder such that the loading mechanism, in an unretracted position, is disposed directly below the wafer holder, and the loading mechanism, in a retracted position, does not interfere with the workpiece holder positioning the workpiece so that bi-directional linear polishing can occur.

33. The apparatus according to claim 27 further including a tensioning mechanism to tension the portion of the polishing belt within the polishing area.

34. The apparatus according to claim 33 wherein the tensioning mechanism is a clutch.

35. The apparatus according to claim 27 wherein the support structure includes a plurality of rollers disposed on a polishing belt path that exists between the supply area and the receive area.

36. The apparatus according to claim 35 wherein the plurality of rollers includes:

a first plurality of rollers that reciprocate vertically, thereby causing the portion to move bi-directionally linearly; and a second plurality of rollers that rotate about a stationary axis, thereby providing the polishing area therebetween.

37. The apparatus according to claim 36 wherein the first plurality of rollers includes at least one roller that moves vertically in one direction when at least another roller moves vertically in an opposite direction.

38. The apparatus according to claim 27 wherein each of the first and second drive mechanisms include a motor.

39. The apparatus according to claim 1 wherein the means for moving includes a plurality of rollers that move to there by cause the section of the polishing belt to move with the bi-directional linear motion while maintaining the two ends of the polishing belt in position.

40. The apparatus according to claim 39 further including means for incrementing the polishing belt between the supply spool and the receive spool to obtain a new section of the polishing belt within the processing area so that fresh polishing belt is removed from the supply spool and used polishing belt is taken up by the receive spool.

41. The apparatus according to claim 39 further including means for tensioning the section of the polishing belt within the processing area.

42. The apparatus of claim 41 further comprising a support plate adapted to support the polishing belt as the portion of the belt polishes the surface of the wafer.

43. The apparatus of claim 42 further comprising an air bearing in between the polishing belt and the support plate.

44. The method according to claim 11 wherein:

the step of polishing by bi-directionally moving the portion of the polishing belt within the polishing area moves the portion of the polishing belt over a support mechanism while maintaining the first end and the second end in position; and the step of polishing by bi-directionally moving the another portion of the polishing belt within the polishing area moves the another portion of the polishing belt over the support mechanism while maintaining the first end and the second end in position.

45. The method according to claim 44, wherein, during the steps of polishing, the ends of the polishing belt not being used for polishing remain rolled within the supply area and the receive area, respectively.

46. The method according to claim 45 wherein:

during the step of polishing by bi-directionally moving the portion of the polishing belt within the polishing area, the portion of the polishing belt is moved using a plurality of moving and rotatable rollers; and during the step of polishing by bi-directionally moving the another portion of the polishing belt within the polishing area, the another portion of the polishing belt is moved using the plurality of moving and rotatable rollers.

47. The method according to claim 46 wherein, during the steps of polishing, there is simultaneously occuring a step of providing a force to the backside of the polishing belt within the polishing area.

48. The method according to claim 47 wherein the step of providing the force applies air.

49. The method according to claim 44 wherein, during the steps of polishing, there is simultaneously occuring a step of providing a force to the backside of the polishing belt within the polishing area.

50. The method according to claim 49 wherein the step of providing the force applies air.

51. The method according to claim 44 wherein, during the steps of polishing, the first end and the second end of the polishing belt remain stationary within the supply area and the receive area, respectively.

52. The method according to claim 44 wherein during the steps of polishing the portion and the another portion of the polishing belt, there is also included the step of tensioning the portion and the another portion of the polishing belt, respectively, within the polishing area.

53. The method according to claim 11 wherein the step of advancing the polishing belt advances the polishing belt in a direction that is the same as that of one of the bi-directional linear movement directions.

54. The apparatus according to claim 27 wherein the first drive mechanism includes a includes a plurality of moving rollers that cause the portion and the another portion, respectively, to move with the bi-directional linear motion while maintaining the two ends of the polishing belt in position.

55. The apparatus according to claim 54 further including a platen within teh workpiece processing area that causes a certain portion of the polishing belt to levitate over the platen and to cause contact, and thereby the polishing, between the frontside of the polishing belt and a frontside of a workpiece being polished.

56. The apparatus according to claim 27 further including a platen within the workpiece processing area that causes a certain portion of the polishing belt to levitate over the platen and to cause contact, and thereby the polishing, between the frontside of the polishing belt and a frontside of a workpiece being polished.

57. A polishing apparatus adapted to polish a surface of a wafer, comprising:

a supply spool and a receiving spool;

a polishing belt having two ends, wherein one end is attached to the supply spool and the other end is attached to the receiving spool;

a processing area having a portion of the polishing belt in between the two ends; and means for moving the portion of the polishing belt in a bi-directional linear motion.

58. The apparatus according to claim 57 further comprising an air bearing in between the polishing belt and a support plate.

59. The apparatus according to claim 58 wherein the means for moving includes a plurality of rollers that move to thereby cause the portion of the polishing belt to move with the bi-directional linear motion while maintaining the two ends of the polishing belt in position.

60. The apparatus according to claim 57 wherein the means for moving includes a plurality of rollers that move to thereby cause the portion of the polishing belt to move with the bi-directional linear motion while maintaining the two ends of the polishing belt in position.

61. The apparatus according to claim 60 further including means for incrementing the polishing belt between the supply spool and the receive spool to obtain a new section of the polishing belt within the processing area so that fresh polishing belt is removed from the supply spool and used polishing belt is taken up by the receive spool.

62. The apparatus according to claim 60 further including means for tensioning the section of the polishing belt within the processing area.

63. The apparatus of claim 62 further comprising an air bearing in between the polishing belt and a support plate.

* * * * *